United States Patent [19]

LaFrasse et al.

[11] Patent Number: 4,979,385

[45] Date of Patent: Dec. 25, 1990

[54] PROCESS AND APPARATUS FOR MONITORING BACKSPRINGING WHEN BENDING AN ELONGATED ELEMENT SUCH AS A PIPE

[75] Inventors: Jean LaFrasse, Dardilly; Jean-Paul Chastan, Ecully, both of France

[73] Assignee: Eaton Leonard Picot S.A., Tassin La Demi Lune, France

[21] Appl. No.: 341,397

[22] Filed: Apr. 21, 1989

[30] Foreign Application Priority Data

Apr. 21, 1988 [FR] France ..... 88 05714

[51] Int. Cl.[5] ..... B21D 7/04; B21D 7/14

[52] U.S. Cl. ..... 72/10; 72/31; 72/149; 72/702

[58] Field of Search ..... 72/9, 10, 31, 149, 150, 72/154, 155, 702

[56] References Cited

U.S. PATENT DOCUMENTS

| | | | |
|---|---|---|---|
| 3,156,287 | 11/1964 | Munro | 72/702 X |
| 3,352,136 | 11/1967 | Clarke | 72/702 X |
| 3,821,525 | 6/1974 | Eaton et al. | 72/702 X |

FOREIGN PATENT DOCUMENTS

| | | | |
|---|---|---|---|
| 0166351 | 1/1986 | European Pat. Off. | 72/702 |
| 109331 | 11/1974 | German Democratic Rep. | |
| 59-92120 | 5/1984 | Japan | 72/702 |
| 1386330 | 4/1988 | U.S.S.R. | 72/702 |
| 87/01625 | 3/1987 | World Int. Prop. O. | 72/702 |

*Primary Examiner*—E. Michael Combs
*Attorney, Agent, or Firm*—Browdy and Neimark

[57] ABSTRACT

Process and apparatus for monitoring the backspringing of an elongated deformable elongated element while the element is bend by winding around a forming component. The element is clamped in a section located forward of the bend to be made. After the bend is made, the front section of the element remains clamped while the back section of the element is released. The backspringing value is determine by means of a sensor which makes a measurement on the back section of the element. The backspringing value is detected during a rotation of the element and the forming component around the axis of the bend by detecting when the back section reaches a predetermined position. This process makes it possible to continue bending of the element after detecting the backspringing value.

8 Claims, 3 Drawing Sheets

A
1
2
3
4
5
6
7
7a
7b
7c
8
9
10
11
12
13

A
B
E
1
2
3
4
5
6
7
7a
7b
7c
8
9
10
12
13

PROCESS AND APPARATUS FOR MONITORING BACKSPRINGING WHEN BENDING AN ELONGATED ELEMENT SUCH AS A PIPE

FIELD OF THE INVENTION

This invention pertains to a process for monitoring backspringing during an operation in which a deformable elongated element is bent. The invention also pertains to a device associated with a bending tool, which is intended for the implementation of said monitoring process. This invention pertains more specifically but not exclusively to monitoring backspringing in pipes in automatic pipe bending machines.

BACKGROUND OF THE INVENTION

The process for making bends in said pipes, characterized by radius and angle, implements tools which normally include a forming roller that rotates around an axis orthogonal to the initial direction of the pipe to be bent, having an annular groove on its periphery and supporting, or forming in and of itself, a first clamping jaw, with a second clamping jaw held by a bending arm mounted to turn around the axis of the forming roller, said second clamping jaw moving on said arm and cooperating with the first clamping jaw in order to hold and pull the pipe to be bent, with a strip parallel to the initial direction of the pipe being placed behind the clamping jaw, designed to be applied laterally against the pipe to be bent.

In this way, in order to form a bend in a section of the pipe to be bent, said section is clamped between the two clamping jaws and moved forward by the rotation control of the bending arm, so as to wind into the groove of the forming roller, while the strip, applied laterally against the pipe behind the section being bent, prevents any undesirable deformation beyond the section to be bent and ensures the reaction to the bending stress.

The dimensional characteristics of the forming roller determine the radius of the bend thus made in the pipe, while the rotation angle of the bending arm determines the angle of the bend. However, because of the phenomenon called "backspringing," the final angle of the bend is always smaller than the set rotation angle of the bending arm.

Consequently, in order to bend a pipe to a specific angle, the rotation of the bending arm must be defined using an angle equal to said value, plus backspringing. This assumes that the backspringing value can be known or determined so that it can be taken into consideration. Of course, said backspringing can be determined theoretically, but it is also important to be able to monitor its actual value in practical applications. Such a need arises especially in adjusting an automatic bending machine before using the latter to make a series of identical bends.

A known procedure for monitoring backspringing consists of detecting the value of said backspringing on the bending machine using mechanical sensors. The implementation of this known process requires that the clamping jaws be opened, releasing the section of the pipe just bent, with the sensors coming into contact with the section of the pipe located in front of the bend formed.

The main problem with the existing process summarized above is that, after backspringing is detected, it is practically impossible to resume the bending of the pipe to reflect said backspringing in order to adjust the bend precisely to the desired angle. Indeed, the pipe needs to be clamped again between the two previously opened clamping jaws. However, the clamping of the pipe in the previous operation cannot be duplicated exactly. Thus, the clamping jaws mark the pipe, making the latter unusable. In this way, the pipe used for monitoring backspringing is wasted, which is unacceptable for pipes that are expensive because of their size and/or the material from which they are made.

Moreover, the sensors currently used to monitor backspringing constitute bulky and cumbersome supplementary devices on bending machines, located in the bending area.

East German Pat. No. DD-A-109331 teaches another process for monitoring backspringing in pipes wherein, after the bend is made, the section of the pipe located in front of said bend remains clamped, while the section of said pipe behind the bend is released, and wherein a measurement or reference mark is made on the section of said pipe located behind the bend in order to determine the backspringing value.

Thus, after bending, the pipe springs back freely, while said pipe remains fastened between the clamping jaws of the bending machine. Backspringing is detected in the released section of the pipe located behind the bend, away from the bending area. The bending can subsequently be resumed, taking the backspringing value into account, without ever interrupting the clamping of the pipe in its section located in front of the bend, and thus without marking the pipe; the pipe used to monitor backspringing is thus never wasted and consequently the principle of such a process is advantageous.

However, East German Pat. No. DD-A-109331 only proposes a device comprising a part having an angular scale mounted on the released section of the pipe and an optical sighting system mounted on the frame of the bending machine, in order to measure or identify pipe backspringing.

Such a device thus comprises a sort of external measuring instrument and its implementation requires that more parts be added to the machine and the pipe to be bent, which constitutes a first problem.

Furthermore, the actual use of such a device to measure backspringing requires two human operations, on the one hand, to perform the sighting and reading of the scale using the optical system, and, on the other hand, to set the machine for the corrective action depending on the reading obtained using the sighting system.

Thus, the use of this device requires a considerable amount of time, and the process for determining backspringing and correction according to the value of said backspringing cannot be automated.

SUMMARY OF THE INVENTION

The object of this invention is to allow rapid and automatic measurement and correction of backspringing without adding external measurement devices, especially to the pipe, and to eliminate the human operations such as sighting and reading a scale, through the use of a device that is simple and especially suitable for numerically-controlled bending machines, now commonly used, which have a computation mechanism.

For this purpose, the invention pertains to a process for monitoring backspringing when a deformable elongated element such as a pipe is bent by winding the element around a forming component, with the element being clamped in a section in front of the bend to be made, the process in the known manner allowing the section of the elongated element such as a pipe located in front of the bend to remain clamped after the bend is made, while the section of the element located behind the bend is released, and allowing the measurement or a marking to be made on the released section of the element located behind the bend in order to determine the backspringing value. The process is characterized in that backspringing is detected after the section of the elongated element such as a pipe located behind the bend is released, defining, for the element and the forming component, a rotation around the axis of the bend, and detecting the moment when the section of the element located behind the bend reaches a given position, as well as the angular position of the forming component at that time. Then, knowing the angular position of the forming component, a simple calculation yields the backspringing value, with the calculation being performed automatically.

The section of the elongated element such as a pipe located behind the bend can especially be released after the bend is made by loosening the clamp holding the element and moving away the strip applied laterally against the element during the bending operation, for bending machines endowed with a clamp and a strip.

The section of the elongated element such as a pipe located behind the bend is advantageously not released until the forming component has defined a rotation in the direction opposite that of the bending previously accomplished, having a value equal to the theoretical backspringing angle, less a small angular deviation.

The device according to the invention, associated with a bending device, intended for implementing the process described above, comprises in the known manner a sensor placed behind the bending device, the former able to detect at least one position of the section of the bent element located behind the bend, after the section is released, the sensor being designed to detect when the section of the bent element behind the bend reaches a given position, while the element and the forming component are rotating, with the angular position of the forming device at the time of the detection providing an indication of the backspringing value.

The sensor is, for example, a photoelectric cell that detects the moment the section of the bent element located behind the bend cuts across a light beam during its rotation.

In one specific embodiment of the device according to the invention, the sensor is held by the bending machine strip, applied laterally against the elongated element such as a pipe to be bent, the strip being moved away from said element and placed in a given position, in order to release the section of the element under consideration located behind the bend. The sensor is preferably held by the rear end of the strip. The device thus requires minimal space and is away from the bending area; although it is held by a mobile component, namely, the strip, the device occupies a fixed and perfectly-defined position when it works to determine the backspringing value for the pipe or other elongated element.

In any event, the invention will be more effectively understood through the description below, with reference to the attached schematic drawing illustrating an embodiment of this process for monitoring backspringing when an elongated element is being bent, as a non-restrictive example.

DETAILED DESCRIPTION OF THE INVENTION

Figure 1:
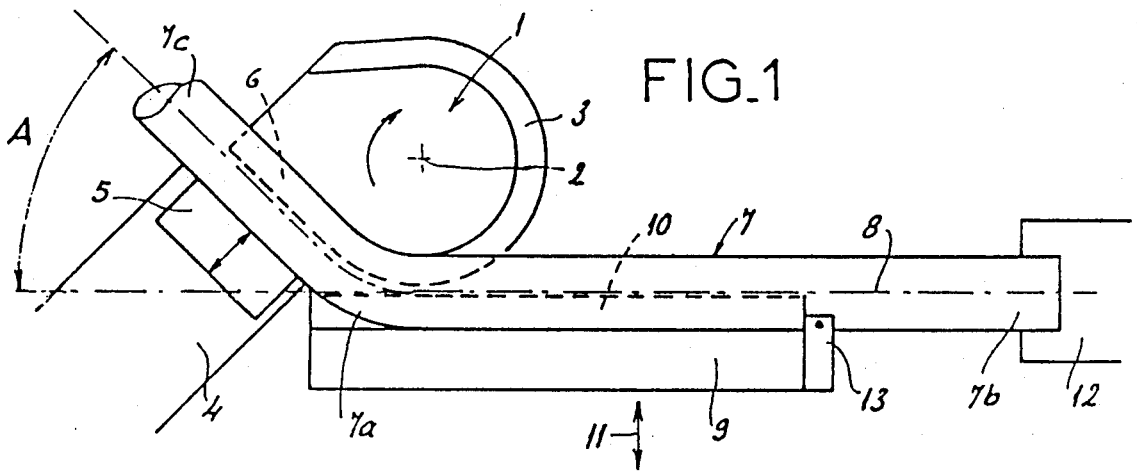
FIGS. 1 to 5 of the drawing provide a schematic representation of the bending tool of a pipe bending machine, illustrating the successive phases of a process for monitoring the backspringing of a pipe according to this invention.

More specifically, FIGS. 1 to 5 show a tool comprising a forming roller 1, mounted to turn around its axis 2 and having an at least partially annular groove 3 on its periphery. A bending arm 4 is also mounted to turn around axis 2, the arm holding a clamping jaw 5 which moves in the radial direction. Clamping jaw 5 cooperates with part 6 of forming roller 1 located opposite the clamping jaw, to clamp an initially-straight pipe 7 to be bent, the initial axis of pipe 7 being indicated in 8.

The bending tool also comprises a strip 9 extending parallel to axis 8 of pipe 7 to be bent, said strip itself having a longitudinal groove 10. Strip 9 can move transversely, as indicated by arrow 11, so that it can either be applied laterally against pipe 7 behind the section to be bent, or it can be moved away from pipe 7. Moreover, strip 9 can be moved longitudinally, thus parallel to axis 8, in order to accompany pipe 7 in its forward movement defined during the bending operation.

The pipe 7 to be bent is held behind its section to be bent using a clamp 12 held by a carriage (not shown) that can move in the direction of axis 8. The movement of the carriage endowed with clamp 12 makes it possible to move the section of the pipe 7 to be bent to the aforementioned tool.

To proceed with the bending of pipe 7, the pipe 7 is clamped between mobile clamping jaw 5 and part 6 of forming roller 1, with strip 9 also being applied against pipe 7, bending arm 4 being turned at an angle A around axis 2, in the direction of Arrow F, as shown in FIG. 1, which illustrates the resting position of arm 4 at the end of the bending operation.

During a process in which the backspringing of pipe 7 is monitored, pipe 7 is first bent to a known value by the controlled rotation of bending arm 4 according to Angle A, as described above in reference to FIG. 1.

Figure 2:
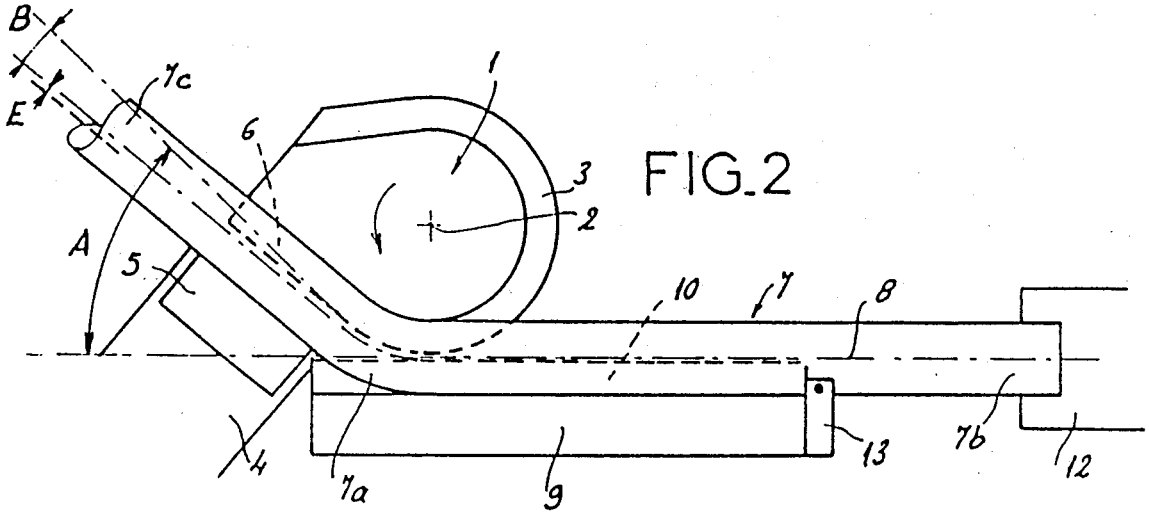

Bending arm 4 is next made to rotate around axis 2 in the direction opposite that of Arrow F, according to an angle $\beta$, the value of which is equal to the theoretical backspringing value of pipe 7 less a small deviation E—see FIG. 2.

Up to this stage, pipe 7 remains held by clamp 12, and strip 9 continues to press against said pipe 7.

Figure 3:
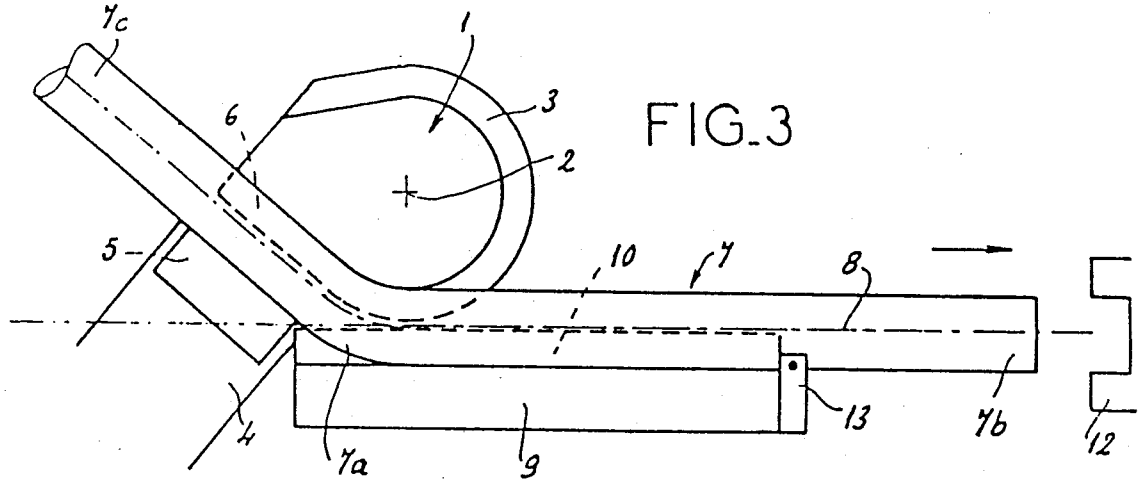
Figure 4:
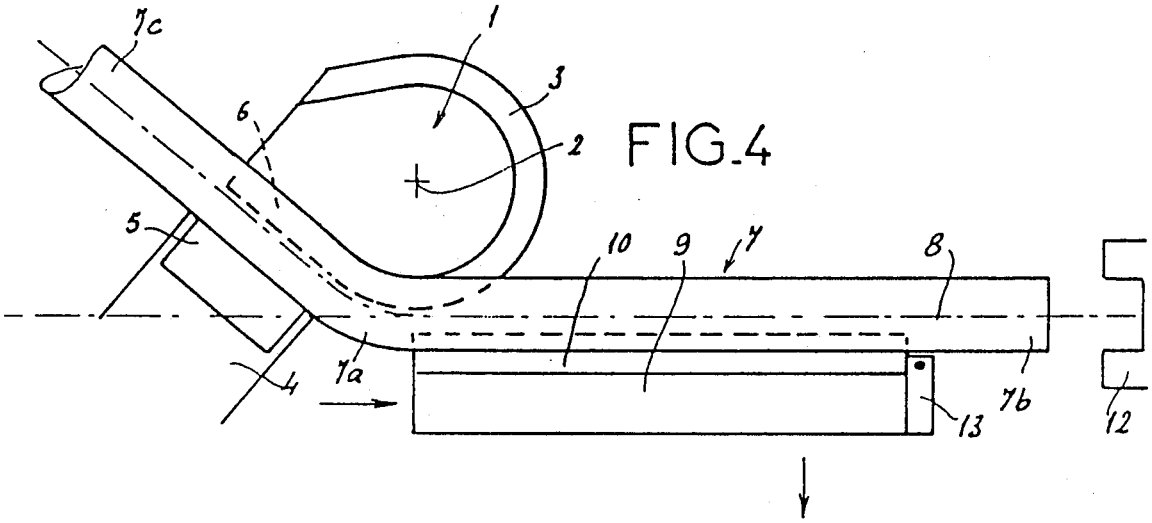
Figure 5:
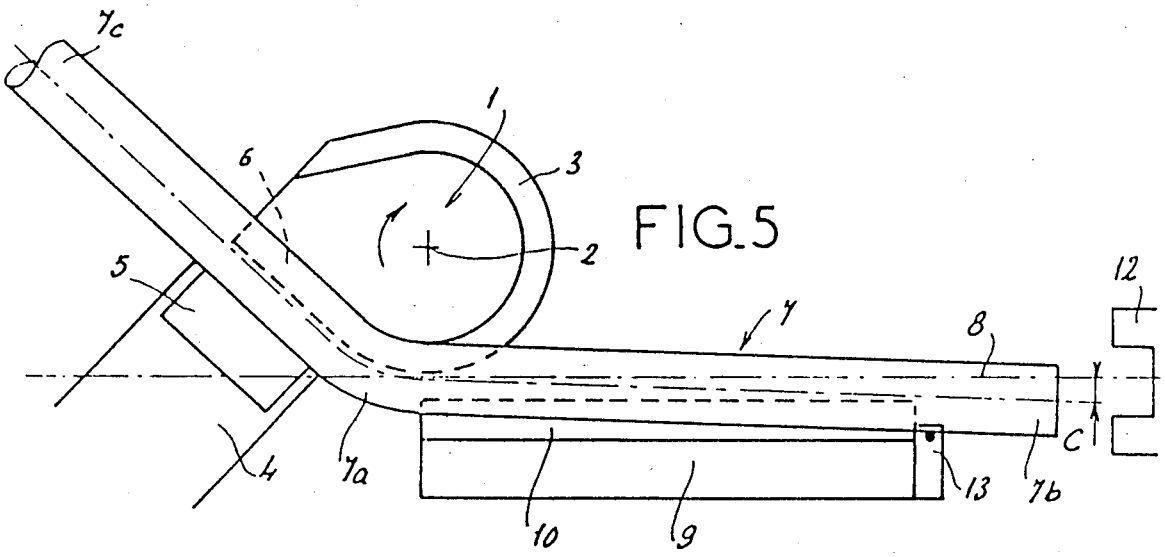

In the subsequent phase, illustrated in FIG. 3, clamp 12 is loosened and the carriage holding said clamp 12 is moved back. Strip 9 is then moved slightly away from pipe 7, as shown in FIG. 4. Simultaneously, strip 9 can be retracted (for a strip 9 that can also move longitudinally), so that it is returned to a clearly-defined reference position.

At this stage, the section of bent pipe 7 forming bend 7*a* and its entire section 7*b* located behind bend 7*a* are totally released. Conversely, section 7*c*, located in front of bend 7*a* of pipe 7 is still held between clamping jaw 5 and part 6 of forming roller 1, with the clamping jaws 5 never being loosened. The release of bend 7*a* of pipe 7 then allows the latter to exercise its backspringing movement, this movement previously being limited to the value of angle $\beta$; this means that the direction of section 7*b* of pipe 7 located behind bend 7*a* can move slightly away from axis 8.

The subsequent phase involves use of a sensor placed in a specific position behind the bending area. In the example provided, the sensor is a photoelectric cell 13, held by the rear end of strip 9.

The last phase consists of rotating forming roller 1 and bending arm 4 in the same direction as during the bending operation, thus in the direction of Arrow F, the rotation of arm 4 being accompanied by a rotation of the entire bent pipe 7 around axis 2, without deforming bend 7*a* of said pipe 7. The rotation is stopped automatically when rear section 7*b* of pipe 7 cuts across the light beam from photoelectric cell 13, with section 7*b* in this case forming an angle C with the direction of axis 8 (see FIG. 5).

At that time, the angular position of forming roller 1 and bending arm 4 is "read" automatically through the use of a coder provided on the bending machine. It is understood that the angular position is a variable that depends on the position pipe 7 assumes after its bend 7*a* is released, and thus varies depending on the angular deviation E defined above. Consequently, a calculation then makes it possible to obtain an indication of the actual backspringing value for pipe 7, based on the angular position of forming roller 1.

The main interest of the process lies in the fact that the real backspringing value is determined while the pipe 7 remains clamped at the same point between clamping jaw 5 and part 6 of forming roller 1. Thus, it is possible to resume the same bend 7*a* in order to produce the exact value desired. For this purpose, strip 9 is again applied laterally against pipe 7, and bending arm 4 is again moved in the bending direction, defining a rotation at an angle equal to the previously determined backspringing value.

The same process can be repeated continuously until the desired bend angle is precisely obtained.

The process thus can be applied to the initial adjustment of a pipe bending machine, before a series of identical bends is made, with the advantage that the first pipe, used for the adjustment, is not wasted or even marked by the loosening of clamping jaw 5, which would subsequently have to be tightened again. This process can also be used for testing by sampling during the production of a series of bends.

The process can be implemented in automatic pipe bending machines, new or existing, with the addition of the sensor (cell 13) to an existing machine merely constituting a minor and easy transformation.

Moreover, the rapidity and automatic nature of the process make it possible in certain cases to use the process not only for an initial adjustment of the machine, but also to monitor the execution of each bend. This is especially the case for bending heterogeneous pipes, for example, having different hardnesses, welding beads, varying thicknesses or outside diameters.

It must be noted that photoelectric cell 13 could be replaced With any equivalent sensor, such as a mechanical sensor activating an electrical contact, the sensor being connected to strip 9 or being independent of said strip, without departing from the spirit of the invention. Moreover, the invention is not necessarily limited to the presence of clamp 12 and the carriage holding said clamp, and it can be applied to a bending machine not endowed with a carriage. Finally, the process according to the invention is not limited to bending pipes, and also pertains to any elongated element, such as a bar or strip, that is bent using similar means and is susceptible to backspringing phenomena.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. Apparatus for monitoring backspringing during bending of an elongated element comprising:

a bending tool including a forming component;

means for clamping a forward and a back section of said element; means for rotating said bending tool and said forming component to bend said clamped element;

means for releasing said back section from it's clamped condition after bending;

a detector located at said back section of said element with respect to said bending tool, which sensor is adapted and constructed to detect at least one position of a back section of said elongated element;

said detector adapted and constructed to detect a point at which said back section reaches a predetermined position during a further rotation of said forming component after bending when said back section is released from clamping an angular position of said forming component providing an indication of backspringing value at the time of said detection.

2. The apparatus according to claim 1 wherein said detector is a photoelectric cell which detects when said back section cuts across a light beam.

3. The apparatus according to claim 1 wherein said bending tool further includes a strip applied laterally against said elongated element;

said strip holds said sensor.

4. The apparatus according to claim 3 wherein a rear end of said strip holds said sensor.

5. A process for monitoring backspringing during the bending of a deformable elongated element, said element having a forward section and a back section, said element to be bent between said forward section and said back section, by winding said element around a forming component wherein said element is clamped at said forward section and said back section, said process comprising:

making a bend in said element;

keeping the forward section of said element clamped while releasing the back section of said element;

rotating said element and forming component around an axis of the bend;

detecting when said back section reaches a predetermined position and simultaneously detecting an angular position of said forming component; and determining a backspring value of said element from said angular position.

6. The process according to claim 5 wherein said element is held by a clamp and a strip applied laterally against said element during the bending operation;

and releasing said back section after the bend is made by loosening said clamp holding said element and removing said strip.

7. The process according to claim 5 wherein after said bend is made, the forming component is rotated in a direction opposite that of the bend, said rotation having a value equal to the theoretical backspringing value for said element, less a small angular deviation.

8. The process according to claim 5 wherein, after the backspringing value is determined, bending of said element is resumed to produce the backspringing value desired.

* * * * *